United States Patent [19]

Upchurch

[11] 4,379,610

[45] Apr. 12, 1983

[54] ELECTRICAL CONNECTOR WITH POLARITY BARRIER

[75] Inventor: James E. Upchurch, Indianapolis, Ind.

[73] Assignee: Woods Wire Products, Inc., Carmel, Ind.

[21] Appl. No.: 232,882

[22] Filed: Feb. 9, 1981

[51] Int. Cl.[3] ..... H01R 13/50; H01R 13/64

[52] U.S. Cl. ..... 339/184 R; 29/858; 339/218 R

[58] Field of Search ..... 339/184, 185, 218; 29/855, 856, 858; 264/250, 254, 255, 271.1, 272.11, 272.14, 272.15, 274, 279, 279.1

[56] References Cited

U.S. PATENT DOCUMENTS

| | | | |
|---|---|---|---|
| 2,993,189 | 7/1961 | Schelke et al. | 339/184 R |
| 3,141,054 | 7/1964 | Francis | 339/59 R |
| 3,487,353 | 12/1969 | Massa | 339/184 R |
| 3,609,630 | 9/1971 | Francis | 339/218 R |
| 4,043,630 | 8/1977 | Suverison et al. | 339/218 M |
| 4,059,888 | 11/1977 | Leh | 29/858 |
| 4,273,409 | 6/1981 | Blanche et al. | 339/218 R |

*Primary Examiner*—Neil Abrams

*Attorney, Agent, or Firm*—Woodard, Weikart, Emhardt & Naughton

[57] ABSTRACT

A female electrical connector with polarity barrier and method of making same. A connector includes a pair of female contacts positioned therein with one of the contacts having a polarity barrier mounted thereon. The polarity barrier includes a top wall and a pair of bottom walls between which is located the contact with the top wall and bottom walls having restricted-size holes extending therethrough to receive only the narrow contact of a male plug. First stops are provided on the barrier for limiting lateral movement between the barrier and contact. A second stop is provided on the barrier to prevent longitudinal movement between the barrier and contact.

2 Claims, 8 Drawing Figures

ELECTRICAL CONNECTOR WITH POLARITY BARRIER

BACKGROUND OF THE INVENTION

This invention is in the field of electrical connectors and more specifically, polarized female connectors. It is known to design electrical connectors in such a manner that the polarity of a two-wire line is maintained through a connection including a male and female connector. Such polarity is maintained by increasing the width of one of the male blades provided on the plug and likewise by increasing the width of one of the holes on the female connector, thereby insuring the wide and narrow blades of the plug fit respectively into the wide and narrow holes of the female connector. The female connector of an electrical extension cord is typically manufactured by placing a pair of metal contacts attached to a pair of wires into an injection mold which in turn forms a nonconductive housing around the contacts. It is known to mount a polarity barrier onto one of the pair of contacts thereby decreasing the size of the female opening on one of the contacts accommodating only the narrow blade on the male plug and maintaining the polarity through the connection. Such a polarity barrier is included in an extension cord manufactured by Pacific Electricord Company of Gardena, Calif. and is shown as prior art with the various components depicted in FIGS. 1–3 herein. My invention is an improved polarity barrier designed to be mounted on the contact prior to insertion of the contact into the injection mold as contrasted to the prior art polarity barrier which is first inserted into the injection mold and then mounted to the contact also within the mold. Further, my polarity barrier is provided with means to limit lateral movement and longitudinal movement between the contact and polarity barrier mounted thereon.

SUMMARY OF THE INVENTION

One embodiment of the present invention is a female polarized electrical connector to receive a polarized electrical plug having a pair of blades, one of which is narrower than the other comprising a first and second female electrical contact, each with a wire extending therefrom, each contact including a top and bottom longitudinally extending edge with receiving means disposed therebetween and sized to receive a blade of the electrical plug, housing means enclosing the first and the second contact and including contact passage means leading externally from the receiving means, a polarity barrier of electrically nonconductive material mounted on the first contact and positioned between the passage means and the receiving means of the first contact and defining at least one contact hole sized to allow passage of only the narrower of the blades of the plug, and first stop means on the barrier with the first stop means engaged with the top and bottom longitudinally extending edges of the first blade limiting relative lateral motion between the first contact and the first barrier.

Another embodiment of the present invention is a method of producing a female electrically polarized connector comprising the steps of attaching a pair of wires to a pair of female electrical contacts, mounting and securing a polarity barrier to one of the contacts, arranging the pair of contacts in a side-by-side relationship, inserting the pair of contacts, one of which has the barrier mounted thereto, into an injection mold, and forming a housing around the pair of contacts while inserted in the mold.

It is an object of the present invention to provide a new and improved polarity barrier for use with a female contact of an electrical connector.

A further object of the present invention is to provide a new and improved method for producing a polarized female connector.

Yet another object of the present invention is to provide a polarity barrier and female connector contact combination wherein lateral movement and longitudinal movement between the barrier and contact is limited.

Related objects and advantages of the present invention will be apparent from the following description.

DESCRIPTION OF THE PREFERRED EMBODIMENT

Figure 1:
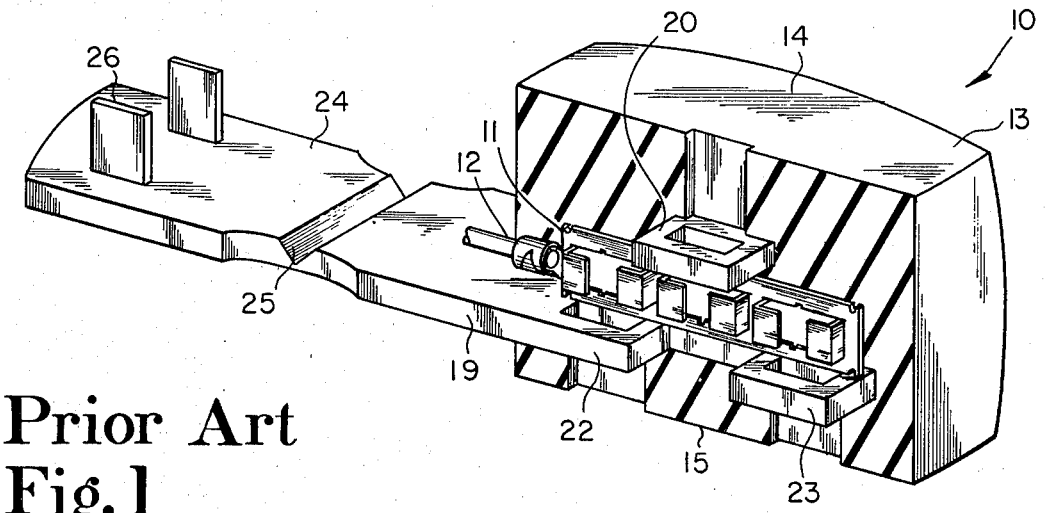
Prior Art Fig. 1
FIG. 1 is a cross-sectional perspective view of a female electrical connector having a polarity barrier therein all being within the prior art.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, a female electrical connector 10 includes a pair of electrical contacts with only one of the contacts 11 being shown. Contact 11 is connected to electrical wire 12. Connector 10 has a main body 13 of typically rubber material with a pair of holes extending inwardly from the top side 14 of main body 13 and with two pairs of holes extending inwardly from the bottom side 15 of main body 13. Contact 11 is identical to the contact not shown and includes three pairs of fingers 16, 17 and 18 (FIG. 3) forming three holes to receive a blade of a male connector inserted into main body 13.

Figure 2:
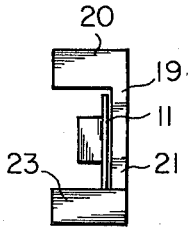
Prior Art Fig. 2
FIG. 2 is an end view of the polarity barrier and contact of FIG. 1.
Figure 4:
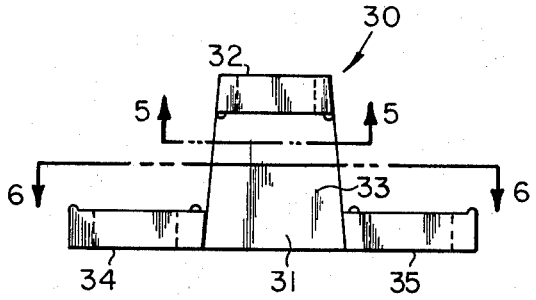
FIG. 4 is a side view of my new and improved polarity barrier.
Figure 5:
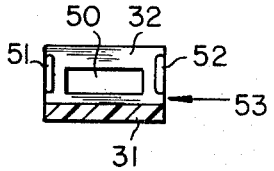
FIG. 5 is a cross-sectional view taken along line 5—5 of FIG. 4 and viewed in the direction of the arrows.
Figure 6:
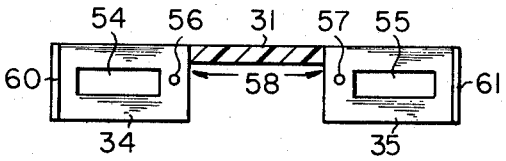
FIG. 6 is a cross-sectional view taken along line 6—6 of FIG. 4 and viewed in the direction of the arrows.

A polarity barrier 19 has a main body of electrically nonconductive material formed in a C-shaped configuration (FIG. 2). Barrier 19 includes a top wall 20 disposed between and integrally connected by a downwardly extending wall 21 to a pair of parallel bottom walls 22 and 23. Each wall 22 and 23 includes a hole extending therethrough aligned with finger pairs 16 and 18, respectively, to restrict the size of the hole formed by the fingers thereby accommodating only the narrow blade of a male plug. Further, top wall 20 includes a hole extending therethrough aligned with finger pair 17 and likewise receiving only the narrow blade of a male plug. Barrier 19 includes a tail 24 attached thereto by a living hinge 25 allowing the tail to be pivoted upwardly to allow the insertion of the pins 26 into the holes formed on the top 14 of the electrical connector when the top holes are not in use.

As shown in FIG. 2, top wall 20 is spaced apart from bottom walls 22 and 23 a distance greater than the height of contact 11 thereby allowing both lateral and longitudinal movement between the contact 11 and polarity barrier 19 prior to formation of main body 13. Thus, the contact 11 and polarity barrier 19 must first be inserted into an injection mold and then positioned together within the mold prior to injection molding of main body 13.

Figure 7:
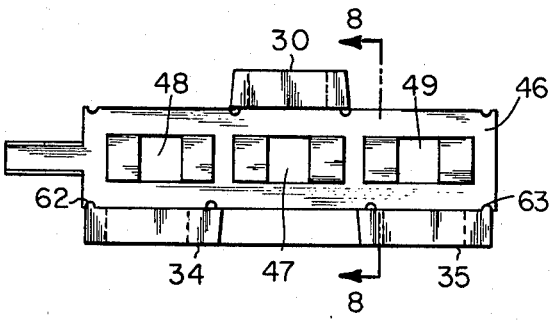
FIG. 7 is the same view as FIG. 4 only showing the contact mounted to the polarity barrier and illustrating the means for limiting longitudinal movement between the barrier and contact.
Figure 8:
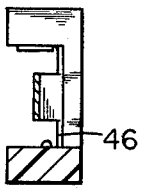
FIG. 8 is a cross-sectional view taken along line 8—8 of FIG. 7 and viewed in the direction of the arrows and illustrating the means for limiting lateral movement between the barrier and contact.
Figure 9:
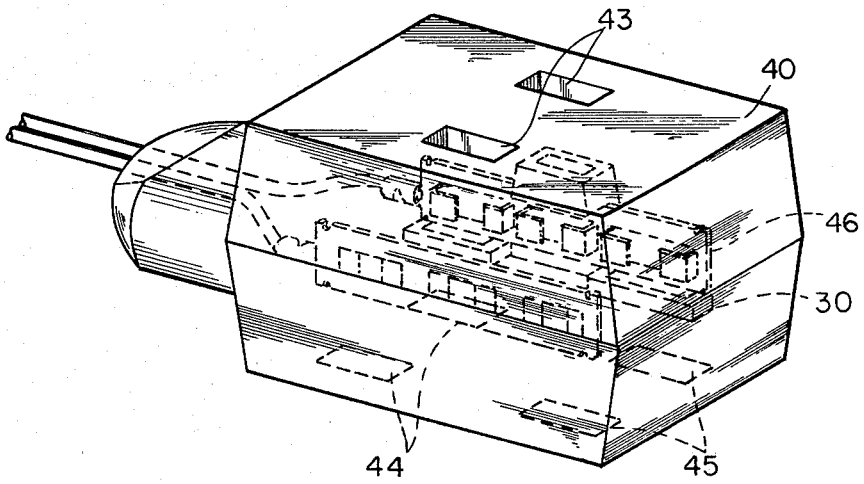

Referring now to FIGS. 4–8, the improved polarity barrier 30 is depicted. Polarity barrier 30 (FIG. 4) includes a main body 31 of an electrically nonconductive material. It will be noted that barrier 30 does not include the tail 24 depicted in the prior art barrier of FIG. 1. Polarity barrier 30 includes a top wall 32 disposed between and integrally connected by a downwardly extending wall 33 to a pair of parallel bottom walls 34 and 35. Walls 32, 34 and 35 are provided with holes extending therethrough to be aligned with the finger pairs 17, 16, and 18, respectively, depicted in FIG. 3. Polarity barrier 30 is mounted to one of the contacts provided in the female electrical connector 40 (FIG. 9) with the second of the contacts within connector 40 being free of any polarity barrier. The female connector 40 receives a polarized electrical plug (not shown) which in turn has a pair of blades, one of which is narrower than the other blade. Connector 40 includes a first and second female electrical contact, each identical to the contact shown in FIG. 3, with a wire extending from each contact externally from the connector. Each contact includes a top and bottom longitudinally extending edge 41 and 42 (FIG. 3) with receiving means disposed between the edges sized to receive a blade of the male electrical plug. The receiving means includes finger pairs 16, 17 and 18. Connector 40 includes a housing of nonconductive material enclosing the pair of contacts with the housing including contact passage means leading externally from finger pairs 16–18. For example, electrical connector 40 has a pair of holes 43 provided on the top portion of the connector and two pairs of holes 44 and 45 provided on the bottom portion of the connector with holes 43–45 providing passage means leading to the blade receiving means provided on each contact within the connector main body. A single-polarity barrier 30 is provided within connector 40 and is mounted to contact 46 which is identical with respect to the contact shown in FIG. 3. Polarity barrier 30 includes a top wall 32 positioned between one of the holes 43 (FIG. 9) and the middle pair of fingers 47 of contact 46 (FIG. 7). Likewise, bottom walls 34 and 35 are positioned between holes 44 and finger pairs 48 and between holes 45 and finger pairs 49, respectively. Thus, the polarity barrier defines a contact hole sized to allow passage of only the narrower of the blades of the male plug as it is extended into the finger pairs of contact 46.

A pair of ridges 51 and 52 (FIG. 5) extends downwardly from the bottom surface of wall 32 with hole 50 positioned therebetween. Ridges 51 and 52 along with hole 50 are spaced apart from the downwardly extending wall 31 providing a channel 53 receiving the top edge of contact 46. Ridges 51 and 52 along with wall 31 provide first stop means on barrier 30 engaged with the top edge of contact 46 limiting relative lateral motion between the contact and barrier. Further, a pair of tits 56 and 57 extending upwardly from the top surface of walls 34 and 35 are positioned along with holes 54 and 55 away from wall 31 forming a channel 58 to receive the bottom edge of contact 46. Tits 56 and 57 along with wall 31 provide the first stop means for limiting relative lateral motion between contact 46 and barrier 30. The first stop means therefore includes at least one projection, either projection 51 or 52, on the downwardly facing surface of wall 32 forming a channel 53 adjacent wall 31 to receive the top edge of contact 46. In addition, the first stop means includes at least one upwardly extending projection, either projection 56 or 57, forming a second channel 58 adjacent wall 31 and aligned with channel 53 to removably secure the contact on the polarity barrier. Top wall 32 extends over and adjacent the top edge of contact 46 since projections 51 and 52 extend downwardly past the top edge of the contact.

Second stop means are provided on polarity barrier 30 to engage the opposite ends of the bottom edge portion of contact 46 to limit relative longitudinal motion between the contact and barrier. For example, walls 34 and 35 have respectively ridges 60 and 61 extending across the width of the walls with the ridges provided on the upwardly facing surfaces of walls 34 and 35 immediately adjacent recesses 62 and 63 (FIG. 7) provided on the bottom edge of contact 46. The ridges and recesses are positioned at the opposite ends of the contact; however, it is to be understood that the ridges and recesses may be located at other positions along the length of the contact to achieve the same result.

Figure 3:
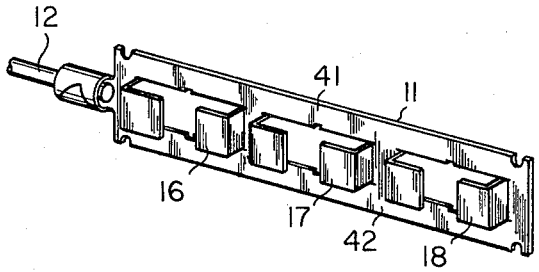
Prior Art Fig. 3
FIG. 3 is a perspective view of the contact shown in FIG. 1.

The method of producing a polarized female connector in accordance with my invention includes the step of attaching a pair of wires to a pair of female electrical contacts, such as shown in FIG. 3. Next, the novel step of my method includes mounting a polarity barrier 30 to one of the contacts prior to inserting the contact into an injection mold. A pair of contacts, only one of which is provided with a polarity barrier, is arranged in side-by-side relationship and then moved to a separate work station by means of a conveyor whereat the pair of contacts is inserted, only one of which has a polarity of barrier mounted thereto, into an injection mold. A housing is then formed around the pair of contacts by injecting material into the mold. Mounting the polarity barrier on one of the contacts includes the substeps of first positioning one edge of the contact, such as the top edge, into a channel formed in the top wall of the barrier. Likewise, the bottom edge of the contact is positioned into the channel formed in the bottom wall of the barrier with the ridges 60 and 61 positioned into recesses 62 and 63 formed in the opposite ends of the bottom edge of the contact. This method is distinguishable over the prior art method in that previously the barrier would not be secured to the contact due to the lack of stop means and thus, the contact and barrier previously were first inserted into the injection mold and then positioned loosely together.

It will be obvious from the above description that the present invention provides a new and improved polarized electrical connector. Further, it will be obvious from the above description that the present invention provides a new and improved means for producing a polarized electrical connector.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A female polarized electrical connector formed within a mold to receive a polarized electrical plug having a pair of blades, one of which is narrower than the other comprising:

a first and second female electrical contact, each with a wire extending therefrom, each contact including a top and bottom longitudinally extending edge with receiving means disposed therebetween and sized to receive a blade of said electrical plug;

housing means formed by said mold and enclosing said first and said second contact and including contact passage means leading externally from said receiving means;

a polarity barrier of electrically nonconductive material mounted on said first contact prior to insertion into said mold for formation of said housing means and positioned between said passage means and said receiving means of said first contact and defining at least one contact hole sized to allow passage of only the narrower of said blades of said plug, said barrier sized to fit with said first contact entirely within said mold;

first stop means on said barrier with said first stop means engaged with said top and bottom longitudinally extending edges of said first contact limiting relative lateral motion between said first contact and said barrier and wherein:

said barrier includes a top wall and a downwardly extending portion integrally connected together, said top wall has a downwardly facing surface which extends over and adjacent said top edge of said first contact with said one contact hole extending though said top wall toward said receiving means, said barrier further includes a bottom portion integrally attached to said downwardly extending portion, said bottom portion has an upwardly facing surface positioned adjacent said bottom edge of said first contact, said first stop means being located on said downwardly facing surface and said upwardly facing surface and holding said first contact adjacent said downwardly facing surface;

said first stop means includes at least one projection on said downwardly facing surface forming a first channel adjacent said downwardly extending portion receiving said top edge of said first contact;

said first stop means further includes at least one projection on said upwardly facing surface forming a second channel adjacent said downwardly extending portion and aligned with said first channel receiving said bottom edge of said first contact.

2. The connector of claim 1 and further comprising:

second stop means on said barrier engaging said edges being operable to limit relative longitudinal motion between said first contact and said barrier;

said second stop means includes a pair of ridges on said barrier and positioned at and engaging opposite ends of said first contact limiting relative motion between said first contact and said barrier.

* * * * *